US006603261B1

(12) United States Patent
Mori

(10) Patent No.: US 6,603,261 B1
(45) Date of Patent: Aug. 5, 2003

(54) FLAT DISPLAY DEVICE AND FABRICATING METHOD OF THE SAME

(75) Inventor: Hiroshi Mori, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/539,381

(22) Filed: Mar. 31, 2000

(30) Foreign Application Priority Data

Apr. 14, 1999 (JP) ..... P11-107087
Aug. 13, 1999 (JP) ..... P11-229339

(51) Int. Cl.[7] ..... H01J 17/49
(52) U.S. Cl. ..... 313/582; 313/584; 313/590; 313/610
(58) Field of Search ..... 313/582, 584, 313/586, 169.4, 590, 610

(56) References Cited

U.S. PATENT DOCUMENTS 3,986,074 A 10/1976 Watanabe ..... 313/485
5,471,112 A 11/1995 Hamon et al. ..... 313/485
5,939,828 A * 8/1999 Matsuzaki et al. ..... 313/484

FOREIGN PATENT DOCUMENTS

JP 6-52802 2/1994
WO WO 83/03157 9/1983

* cited by examiner

*Primary Examiner*—Sandra O'Shea
*Assistant Examiner*—Guiyoung Lee
(74) *Attorney, Agent, or Firm*—Rader, Fishman & Grauer PLLC; Ronald P. Kananen

(57) ABSTRACT

To provide an AC driving type matrix plasma discharge display device which can reduce power consumption and a fabricating method of the same.

First and second substrates 1 and 2 are disposed so as to oppose each other, and a first electrode group 21, which is constituted so that a plurality of first discharge electrodes 11 are disposed, is formed on the first substrate 1, and a second electrode group 21, which is constituted so that a plurality of second discharge electrodes 12 are disposed, is formed on the second substrate. A plasma discharge display is executed by mainly utilizing a cathode glow discharge.

8 Claims, 5 Drawing Sheets

FLAT DISPLAY DEVICE AND FABRICATING METHOD OF THE SAME

BACKGROUND OF THE INVENTION

1. Field of the Invention

The present invention relates to a flat display device for executing an AC plasma discharge display and a fabricating method of the same.

2. Description of the Related Art

In general, there is a flat plasma discharge display device adopting a double-electrode system, namely, so-called matrix display mode where first and second electrodes, each of which is constituted so that a plurality of parallel electrodes are disposed called X electrodes and Y electrodes, are provided and an aimed display is executed in a plasma discharge between electrodes selected from both the electrode groups (for example, Japanese Patent Application Laid-Open No. 6-52802 (1994)).

Such a kind of matrix plasma discharge display device is constituted so that surroundings of opposing first and second substrates are sealed so that an airtight space is formed between both the substrates. A first electrode group, which constitutes one discharge electrode by disposing first electrodes extended along a first direction, is formed on an inner surface of the first substrate, and a second electrode group, which constitutes the other discharge electrode by disposing second electrodes extended to a second direction perpendicularly crossing the first direction, is formed on an inner surface of the second substrate.

A dielectric layer is formed on both surfaces of the first and second electrode groups, and a surface layer consisting of MgO or the like is further formed thereon.

Furthermore, fluorescent material which emits a required light is provided on both sides of, for example, one electrode between the first and second electrodes.

In this configuration, a required AC voltage is applied between the selected first and second electrodes so that a discharge takes place, and the fluorescent material is illuminated by an ultraviolet ray generated by the discharge so that an aimed color display is executed.

Incidentally, in a normal matrix plasma discharge display device, spacing between the electrodes is set to 130 $\mu$m to 200 $\mu$m, for example, and a so-called negative glow discharge takes place. However, in the discharge mode which mainly utilizes such the negative glow discharge, a driving voltage and driving current are comparatively high and power consumption is increased, and in a flat display device whose screen has a tendency to be enlarged, reduction in the power consumption is highly demanded.

The present invention provides an AC driving type matrix plasma discharge display device and a fabricating method of the same.

SUMMARY OF THE INVENTION

A flat display device of the present invention is constituted so that: first and second substrates are disposed so as to oppose each other; a first electrode group which is constituted so that a plurality of first electrodes are disposed is formed as one discharge electrode on the first substrate; a second electrode group which is constituted so that a plurality of second electrodes are disposed is formed as the other discharge electrode on the second substrate; and a plasma discharge display is executed in a cathode glow discharge.

In addition, a method of fabricating a flat display device according to the present invention includes: the step of forming a first electrode group, which is constituted so that a plurality of first electrodes are disposed with their mainly extended direction defined as a first direction along a surface of a first substrate, on the first substrate; the step of forming grid-state projecting bars which are composed of projecting bar portions, which are extended to a direction crossing the discharge maintaining electrodes and arranged in parallel at predetermined intervals, and intersecting projecting bar portions, which cross the projecting bar portions and are extended along between the discharge maintaining electrodes; the step of forming a projecting wall group, which is constituted so that a plurality of projecting walls extending to a second direction along a surface of the second substrate are disposed in parallel, on the second substrate; the step of flying an electroconductive material onto the projecting walls from a diagonally upper direction crossing the second direction and depositing the electroconductive material selectively to top portions of the projecting walls and side walls in the neighborhood of the projecting walls so as to form second electrodes by the electroconductive material formed on the top portions of required projecting walls, on the second substrate; and the step of applying a fluorescent layer between the projecting walls, wherein the first and second substrates are made to oppose each other so that said first and second directions cross each other, and said projecting walls and said intersecting projecting bar portions at least work together so that spacing between said second electrodes and said first electrodes is set to predetermined spacing.

According to the flat display device of the present invention, since the discharge is allowed to take place by utilizing the cathode glow discharge, a driving power can be reduced further than the case of the negative glow discharge, and a power saving effect particularly in a large-screen display is improved.

In addition, according to the fabricating method of the present invention, the second electrodes which are separated from each other are formed easily and accurately by the method of allowing the electroconductive material to fly from the diagonal direction to the projecting walls so as to form the second electrodes isolatedly on the top portions of the projecting walls.

DESCRIPTION OF THE PREFERRED EMBODIMENTS

Figure 1:
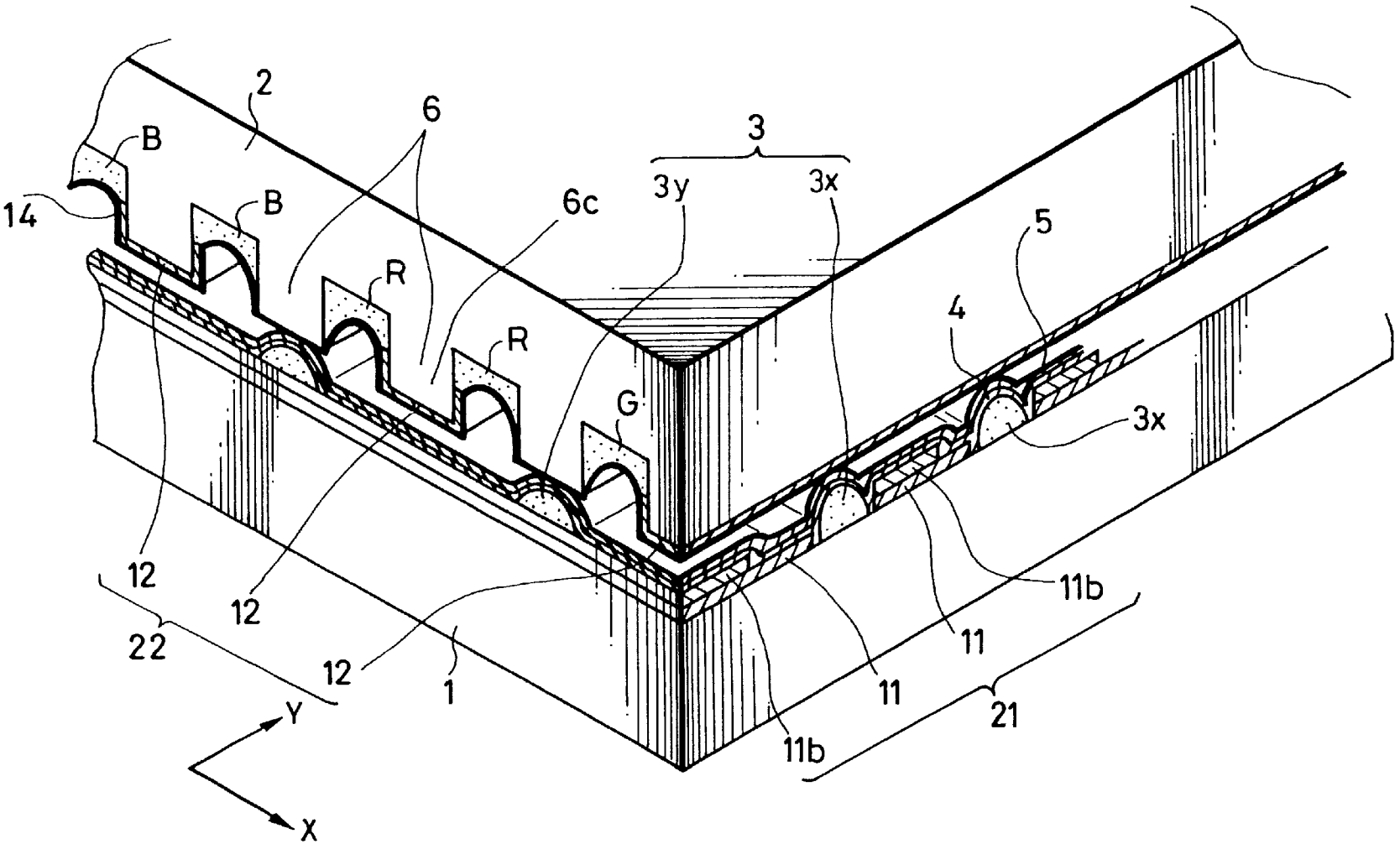
FIG. 1 is a schematic perspective view of a main portion of a flat display device according to one embodiment of the present invention.
Figure 2:
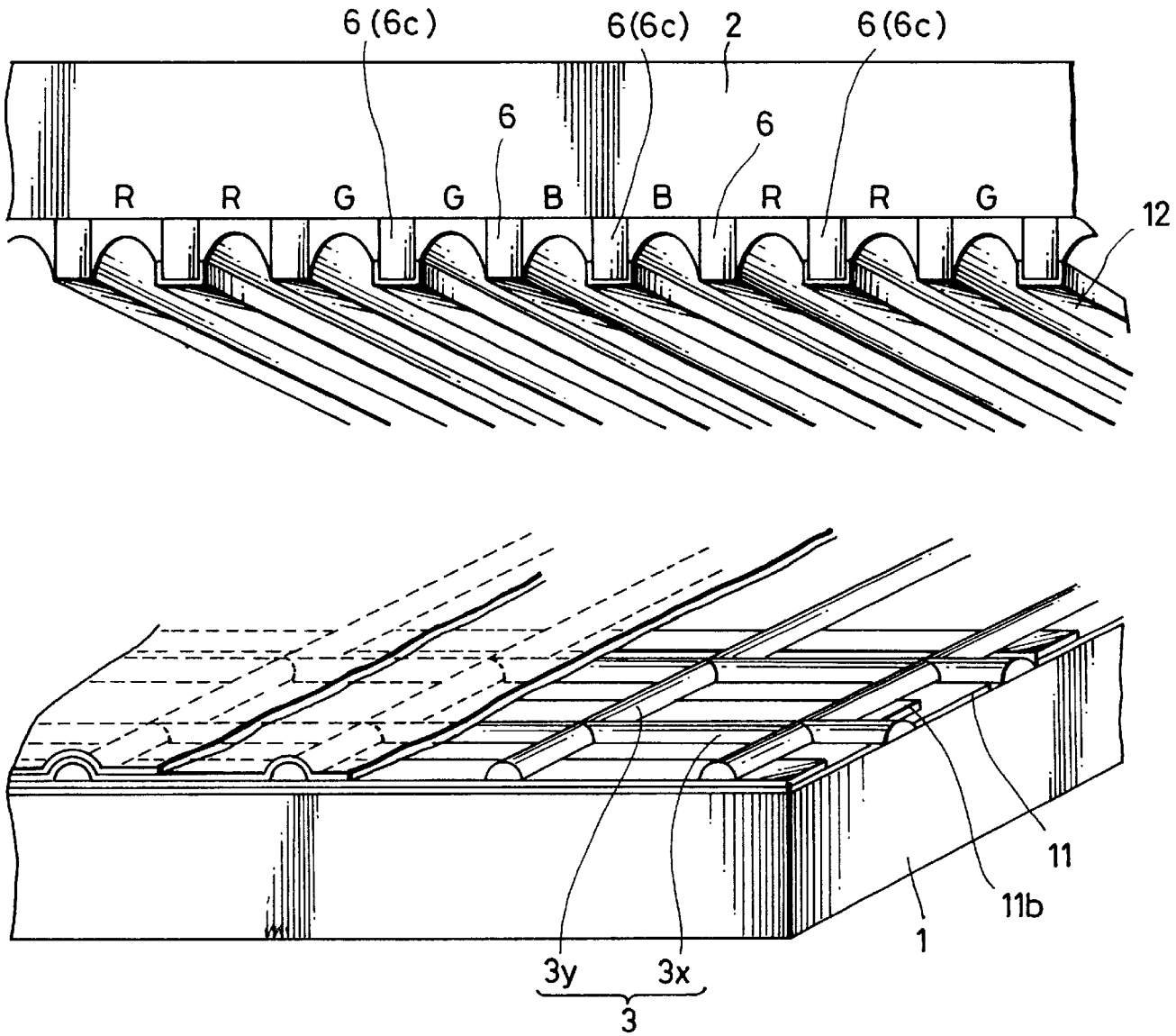
FIG. 2 is an exploded perspective view of the main portion of the flat display device according to one embodiment of the present invention.
Figure 3:
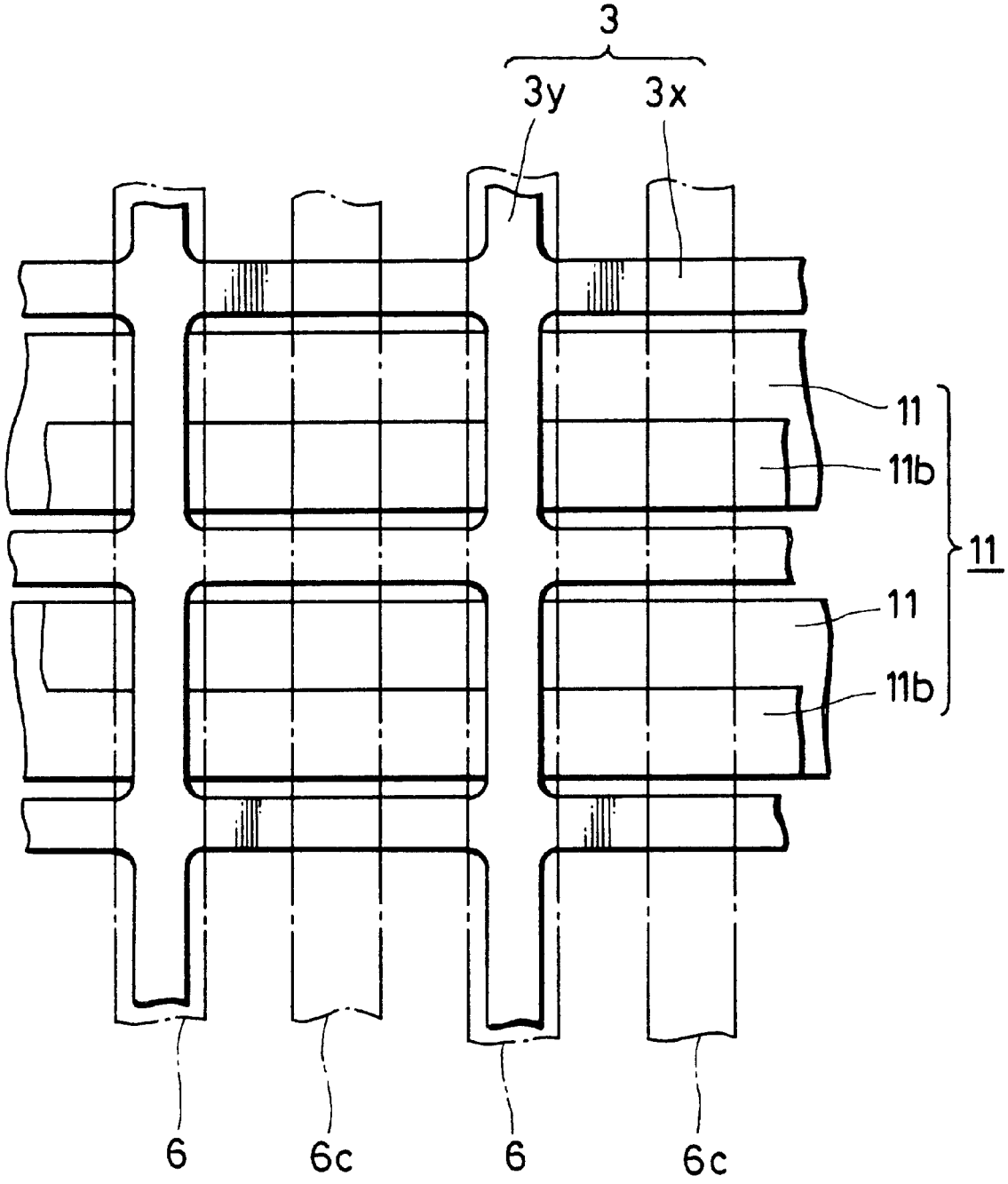
FIG. 3 is a rear view of the main portion of the flat display device according to one embodiment of the present invention.

There will be described below a flat display device according to one embodiment of the present invention with reference to the diagrams. FIG. 1 is a schematic perspective view showing a main portion of the flat display device, and FIG. 2 is an exploded perspective view showing the main portion. Moreover, FIG. 3 is a plan view viewed from a rear surface of the main portion. However, the present invention is not limited to this example.

The flat display device according to the present invention is constituted so that first and second substrates 1 and 2 each being made of a glass substrate, for example, oppose each other, and, not shown, surroundings of both the substrates 1 and 2 are sealed airtightly by a frit seal or the like.

This example relates to the case where luminous display is observed from a side of the first substrate 1, and in this case, at least the first substrate 1 is made of a transparent glass substrate, for example, through which a display light passes.

A first electrode group, namely, a first discharge electrode group 21, which is constituted such that a plurality of first electrodes, namely, first discharge electrodes 11 to be discharge electrodes on one side which are made of transparent electroconductive layers such as ITO (indium tin oxide) are disposed in parallel into a stripe state, for example, with their mainly extended direction defined as a first direction along the surface of the substrate 1, namely, a direction X in the diagram, is provided on an inner surface of the first substrate 1.

In the case where the first electrodes 11 are formed by transparent electroconductive layers, since their electroconductivity is comparatively low, so-called bus electrodes 11*b*, which are made of Al, for example, with excellent electroconductivity for compensating for the electroconductivity of the first electrodes 11, are deposited along the mainly extended direction of the first electrodes 11.

In addition, projecting bar portions 3*y*, which cross the first electrodes 11 and are extended to a second direction Y perpendicularly crossing the direction X, are formed in parallel at predetermined spacing, and at the same time, crossing projecting bar portions 3*x* which cross the projecting bar portions 3*y* and are extended to the direction X, are formed so that a grid-state projecting bars 3 are formed on the first substrate 1.

The crossing projecting portions 3*x* are formed between the first electrodes 11 so as to or not to partially straddle the first electrodes 11.

A dielectric layer 4 is deposited onto a whole surface of the first substrate 1 with a thickness which is not more than half of spacing between the first electrodes 11, and a surface layer 5, which has a small work function and protects the electrodes and is made of MgO, for example, is formed thereonto.

In addition, stripe type projecting walls 6, for example, which extend along the second direction, i.e., the direction Y correspondingly to the projecting bar portions 3*y* of the projecting bar 3 on the first substrate 1 and are disposed one by one between the projecting bar portions 3*y*, are formed on an inner surface of the second substrate 2. Namely, the projecting walls 6 are formed at a pitch which is ½ of the pitch of the projecting bar portions 3*y*.

Moreover, second electrodes, namely, second discharge electrodes 12 are deposited on the top portions of the projecting walls 6*c* positioned, specifically, between the projecting bar portions 3*y* in the stripe state along the extended direction of these projecting walls 6 so that a second electrode group, namely, a second electrode group 22 is formed.

In this configuration, by making the projecting walls 6 and the projecting bar portions 3*y* to come into contact with each other or join each other, and by selecting their height, spacing between the first and second substrates 1 and 2, namely, spacing between the first and second electrodes 11 and 12 is set to less than 50 $\mu$m, preferably less than 20 $\mu$m, and that is, the interval is set so that the cathode glow discharge is possible.

Fluorescent layers which emit lights of the same color are disposedly formed respectively on both sides of each of the projecting walls 6*c* on which each of the second electrodes 12 is formed. For example, in the case where a color flat display device is formed, a fluorescent material R which emits a red light is provided in groove portions between both the projecting walls 6 on both sides of one projecting wall 6*c*, and on the left and right sides of the two groove portions, in respective groove portions between other projecting walls 6*c* and projecting walls 6 on both sides thereof, which respectively neighbor each other, a fluorescent material G which emits a green light and a fluorescent material B which emits a blue light are diposedly provided.

In such a manner, the projecting bar portions 3 and projecting walls 6 on the first and second substrates 1 and 2 work together in isolating the discharge so that discharge areas which are separated from another one are formed, and in these areas, pixel areas where lights of respective colors are emitted are formed.

Airtight spacing formed by the first and second substrates 1 and 2 is evacuated and required gas, i.e., one or more kinds of gas selected from He, Ne, Ar, Xe and Kr, for example, such as mixed gas of Ne and Xe, namely, so-called Penning gas is sealed into the airtight spacing under air pressure of 0.05 to 5.0, for example. In this case, a gas circulating section can be formed to the extent the discharge does not exert an influence on another portion so that the discharge areas can be evacuated and gas can be sealed smoothly.

According to the above-described flat display device of the present invention, since the interval between the first and second electrodes 11 and 12 can be set to less than 50 $\mu$m, preferably less than 20 $\mu$m, the discharge is allowed to take place therebetween mainly by utilizing the cathode glow discharge.

In such a manner, a driving voltage and driving electric current, namely, a driving electric power can be reduced compared with the case of a negative glow discharge, and particularly the power consumption which becomes a problem in the large-screen display can be reduced. Namely, needless to say, the cathode glow discharge in the present invention mainly means the one from the standpoint of its purpose, but it includes the case that another discharge mode is mixed partway and incidentally due to some causes.

There will be described blow a fabricating method of the flat display device according to one embodiment of the present invention. This embodiment refers to the case that the apparatus shown in FIGS. 1 through 3 is obtained, and one example will be described. However, the fabricating method of the present invention is not limited to this example.

At first, the description will be given as to one example of the fabricating method on the first substrate 1 side. In this case, the transparent glass substrate 1, for example, is prepared, and the first electrode group 21 is formed on the inner surface of the substrates 1. In this case, a transparent electroconductive layer such as ITO is deposited on the whole inner surface of the substrate 1 as thick as about 300 nm, for example, and the transparent electroconductive layer is pattern-etched by photolithography so that the plurality of stripe-formed first electrodes 12 are formed. Namely, a photoresist layer is applied to ITO formed on the whole surface and baked, and is subjected to exposure and development of a required pattern so that an objective etching mask which is disposed in parallel is formed. Then, this etching mask is used so that the transparent electroconductive layer is pattern-etched in an etching solution made of a mixed solution of hydrochloric acid and ferric chloride, and the first electrodes 11 are formed.

Next, the bus electrodes 11*b* are formed. At this time, at first, a material with excellent electroconductivity such as A1 is vapor-evaporated on the whole inner surface of the first substrate 1 as thick as about 1 μm so as to cover the first electrodes 11. Then, the above-mentioned pattern etching is executed by means of photolithography by using phosphoric acid as the etching solution so that the bus electrodes 11*b* are formed on the first electrodes 11 so as to cover a partial width of the electrodes 11.

The grid-state projecting bars 3 which are constituted by the projecting bar portions 3*y* and the intersecting projecting bar portions 3*x* are formed by a printing method, for example, in a height of 20 μm and a width of 30 μm to 40 μm, for example.

Thereafter, the dielectric layer 4 made of $SiO_2$, for example, is formed on the whole surface by the CVD (Chemical Vapor Depositions) method or the like, and MgO is vacuum-evaporated thereon as thick as about 0.5μm to 1.0 μm so that the surface layer 5 is formed.

Meanwhile, as for the fabricating method on the second substrate 2 side having the second electrodes, at first the description will be given as to the case where the projecting walls 6 are formed by the printing method.

In this case, glass paste is overprinted plural times. A thickness per each printing process in this case is about 10 μm, and this printing is repeated so that stripe printing as high (thickness) as 50 μm to 80 μm is executed. Thereafter, baking at 500° C. to 600° C., for example, is executed. As a result, the projecting walls 6 as high as 30 μm to 60 μm can be formed.

Figure 4A:
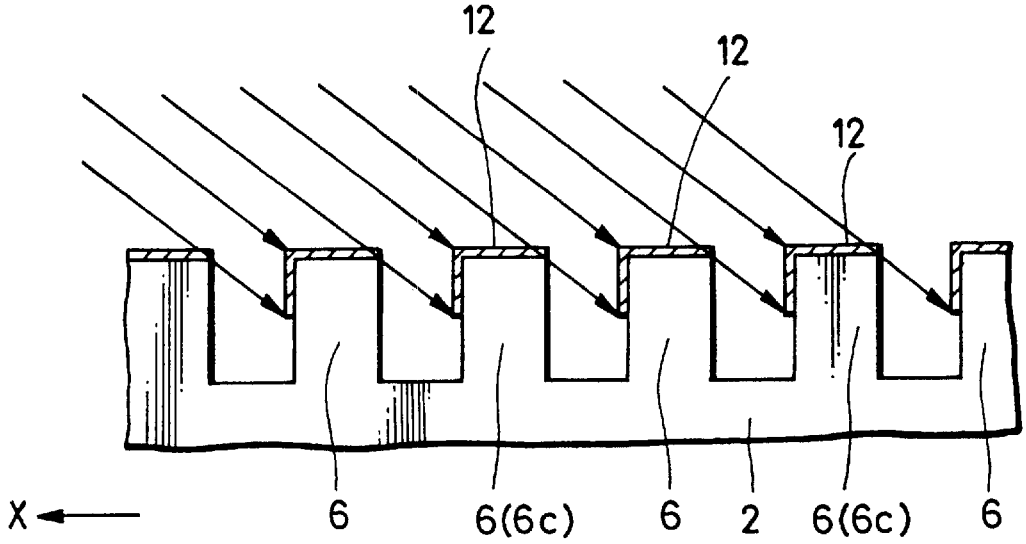
FIGS. 4A and 4B are cross sectional views of the main portion at a step of fabricating second electrodes in a fabricating process of the flat display device according to another embodiment of the present invention.

Thereafter, the electroconductive layer is formed on top portions of at least every other projecting walls 6*c* of the projecting walls 6. When the electroconductive layer is formed, as shown in FIG. 4A, an electroconductive material such as Al is deposited from the diagonally upper direction X along the paper surface to the projecting walls 6 formed along the direction Y perpendicularly intersecting the paper surface of FIG. 4A by way of the vacuum evaporation method, for example, having directional property in a direction where the electroconductive material flies, namely, so-called diagonal vacuum evaporation. As a result, portions to which the electroconductive material 13 is not deposited are formed on base portions of the projecting walls 6 which are in the shade of the adjacent projecting walls 6 so that the electroconductive material 13 is formed isolatedly on each of the projecting walls 6. Therefore, the electroconductive material 13, which is separated from the electroconductive material 13 of the projecting walls 6 on both sides of the projecting walls 6*c*, is deposited on the every other projecting walls 6*c* so that the second electrodes 12 can be formed respectively on the projecting walls 6*c* by the separated electroconductive material 13.

Figure 4B:
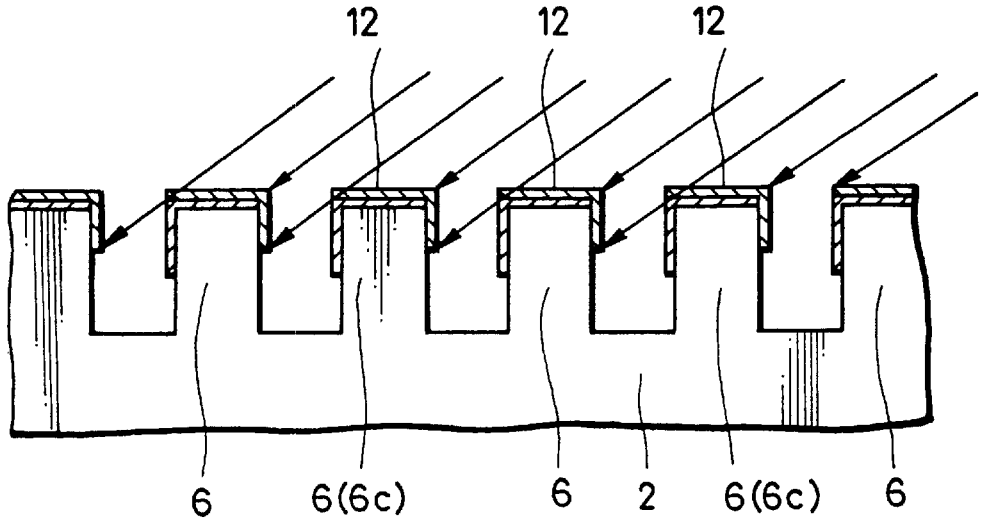

Further, as shown in FIG. 4B, as the need arises, the similar diagonal vacuum evaporation is executed from diagonally above on the opposite side of FIG. 4A so that the electroconductive material 13 can be formed thicker.

In addition, thereafter as the need arises, in the example shown in FIGS. 1 and 2, the electroconductive material 13 on the projecting walls 6 other than the projecting walls 6*c* can be removed by pattern etching utilizing photolithography, but the electroconductive material 13 can remain on all the projecting walls 6.

Thereafter, photosensitive fluorescent slurry having fluorescent materials of respective colors is applied successively into the grooves between the adjacent projecting walls 6 which sandwich the respective projecting walls 6*c* and is stuck repeatedly. As shown in FIG. 1, the red, green and blue fluorescent materials R, G and B are deposited to both sides sandwiching the respective projecting walls 6*c* so that the fluorescent surfaces are formed.

Further, a surface layer 14 made of MgO or the like (not shown in FIG. 2) is formed on the whole surface.

In such a manner, the second substrate 2 side is fabricated.

Thereafter, the first and second substrates 1 and 2 are made to oppose each other in the above-mentioned positional relationship, and are frit-sealed, and they are evacuated and gas is sealed thereinto so that the aimed flat display device is formed.

In this case, the end portions of the bus electrodes 11*b* and the end portions of the second electrodes 12 are led out to the end portions of the substrates 1 and 2 which extend out of the airtight space so as to be used as feed terminals which are led to the first electrodes 11 and the second electrodes 12.

According to the above-described method of the present invention, in the case where the second electrodes 12 are deposited onto the top portions of the projecting walls 6*c* by the diagonally vacuum evaporation, the second electrodes 12 can be separated from each other easily. However, the method of forming the second electrodes 12 by the device of the present invention is not limited to the above-described vacuum evaporation method utilizing the diagonal flying, and a method of depositing the second electrode onto the whole surface and removing it from the groove bottom portions by means of the pattern etching utilizing photolithography can be adopted.

In addition, in the above method, the glass paste is pattern-printed repeatedly, namely, overprinted so that the projecting walls 6 are formed. However, the glass paste is printed on the whole surface as thick as 50 μm to 80 μm and is dried, and a photosensitive film is laminated on the whole surface so as to be exposed and baked into a parallel stripe a state, and is developed. Thereafter, the photosensitive film is sandblasted as a mask so that unnecessary glass layer portion is removed, and the photosensitive film is removed and baking is executed at 500° C. to 600° C. so that the projecting walls 6 with a required height can be formed.

Figure 5A:
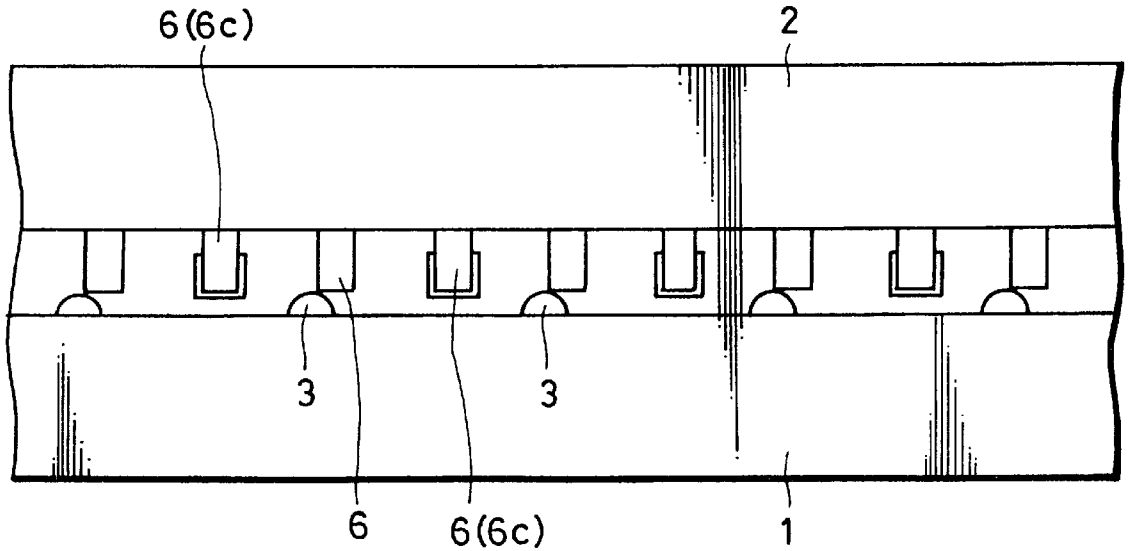
FIGS. 5A and 5B are cross sectional views of the main portion for explaining features of the flat display device of the present invention.
Figure 5B:
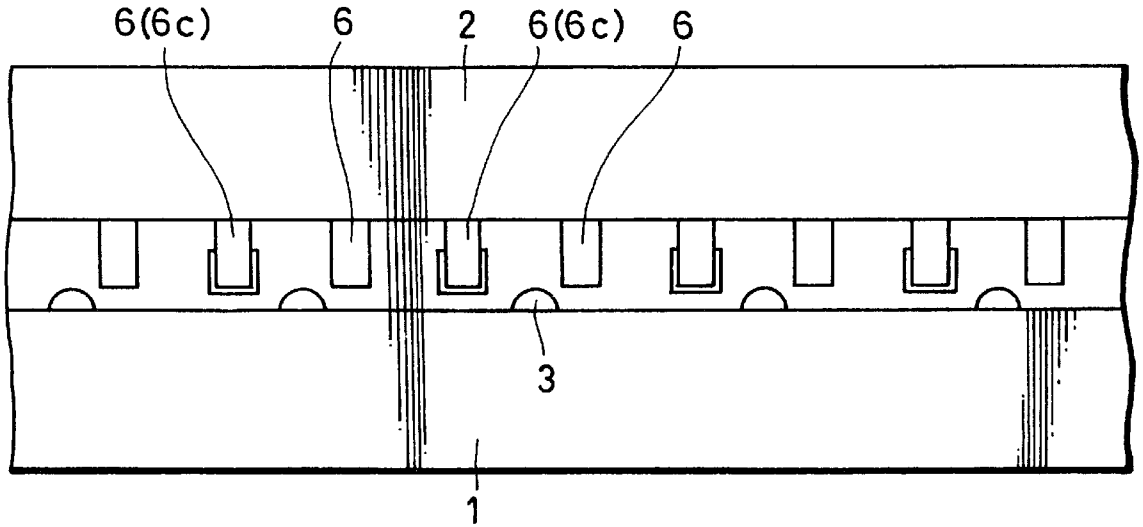

As mentioned above, in the step of fabricating the aimed flat display device, the heat treatment at a high temperature is given and thus the first and second substrates 1 and 2 contract, and as a result, as shown in FIGS. 5A and 5B, for example, the projecting walls 6 are occasionally displaced from the projecting bar portions 3*y*. However, also in this case, since the crossing projecting bar portions 3*x* are formed and the projecting walls 6 can always come into contact with the intersecting projecting bar portions 3*x*, the spacing between the substrates 1 and 2, namely, the spacing between the second electrodes 12 and the first electrodes 11 can be set to a predetermined one, namely, to less than 50 μm, preferably less than 20 μm.

The present invention is not limited to the above-mentioned example, and, for example, the first and second substrates can be constituted by the whole surface and rear panel constituting the airtight flat container constituting the flat display device, or can be constituted by opposing substrates which are disposed in the airtight flat container. Namely, various modifications and changes can be made.

As mentioned above, according to the flat display device of the present invention, since there is put in place the configuration in which the cathode glow discharge takes place, the driving electric power can be reduced further than in the case of the negative glow discharge, and particularly the electricity-saving effect on the large-screen display can be improved.

In the actual fabrication, in the case the first and second substrates 1 and 2 are constituted by low-priced lead glass or the like, the lead glass contracts greatly due to the heat treatment at a high temperature. However, as mentioned above, when the projecting bars 3 are formed into the grid-state shape, even if the substrates 1 and 2 are displaced, the spacing between the first and second substrates 1 and 2, namely, the interval between the second electrodes and the first electrodes can be maintained at predetermined spacing. As a result, the narrow distance between the electrodes, which becomes a problem in the case of the cathode glow discharge, can be set securely, and the flat display device with high reliability can be constituted securely.

In addition, according to the fabricating method of the present invention, when the projecting walls 6 are formed on the second substrate and the second electrodes are formed on the top portions of the projecting walls 6 by diagonal flying, the electroconductive material can be formed isolatedly on the top portions of the projecting walls. As a result, the step of separating the electroconductive material between the projecting walls is omitted, and the fabrication is simplified.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A flat display device, comprising:

first and second substrates are disposed so as to oppose each other;

a first electrode group which is constituted so that a plurality of first electrodes are disposed is formed as one discharge electrode on said first substrate;

a second electrode group which is constituted so that a plurality of second electrodes are disposed is formed as the other discharge electrode on said second substrate; and mainly, a plasma discharge display is executed by a cathode glow discharge, wherein said first electrodes are disposed with their main extended direction defined as a first direction along a surface of said first substrate;

a plurality of projecting walls which are extended to a second direction crossing the first direction are disposed in parallel on said second substrate along a surface of said second substrate; and said second electrodes are formed respectively on top portions of at least every other projecting walls of said projecting walls.

2. The flat display device as claimed in claim 1, wherein spacing between said second electrodes formed on top portions of said projecting walls and said first electrodes which oppose said second electrodes is set to less than 50 $\mu$m.

3. The flat display device as claimed in claim 1, wherein spacing between said second electrodes formed on top portions of said projecting walls and said first electrodes which oppose said second electrodes is set to less than 20 $\mu$m.

4. The flat display device as claimed in claim 1, wherein grid-state projecting bars, which are constituted by projecting bar portions extending along the second direction and intersecting projecting bar portions extending along the first direction and crossing said projecting walls on the first substrate, are formed on said first substrate.

5. The flat display device as claimed in claim 1, wherein color fluorescent materials are formed on said second substrate so that color display is executed.

6. The flat display device as claimed in claim 5, wherein a fluorescent material of the same color as that of the color fluorescent material contacts both sides of a respective one of said second electrodes of said second substrate.

7. A method of fabricating a flat display device, characterized by comprising:

the step of forming a first electrode group, which is constituted so that a plurality of first electrodes are disposed with their mainly extended direction defined as a first direction along a surface of a first substrate, on said first substrate;

the step of forming grid-state projecting bars which are constituted by projecting bar portions, which are extended to a direction crossing said first electrodes and arranged in parallel at predetermined spaces, and intersecting projecting bar portions, which cross said projecting bar portions and are extended along between said first electrodes;

the step of forming a projecting wall group, which is constituted so that a plurality of projecting walls extending to a second direction along a surface of said second substrate are disposed in parallel, on said second substrate;

the step of flying an electroconductive material onto said projecting walls of said second substrate from a diagonally upper direction crossing the second direction and depositing the electroconductive material selectively to top portions of said projecting walls, and side walls in the neighborhood of said projecting walls so as to form second electrodes by the electroconductive material formed on the top portions of the required projecting walls; and the step of applying a fluorescent layer between said projecting walls, wherein said first and second substrates are made to oppose each other so that said first and second directions cross one another, and said projecting walls and said intersecting projecting bar portions at least work together so that spacing between said second electrodes and said first electrodes is set to predetermined spacing.

8. The method of fabricating the flat display device as claimed in claim 7, characterized by further comprising the step of, after the step of depositing the electroconductive material, removing a portion of the electroconductive material except for a composing portions of said second electrodes.

* * * * *